United States Patent [19]

Yarahmadi

[11] Patent Number: 4,890,663

[45] Date of Patent: Jan. 2, 1990

[54] METHOD FOR PRODUCING A CERAMIC-COATED METALLIC COMPONENT

[75] Inventor: Mohamed Yarahmadi, Fulda, Fed. Rep. of Germany

[73] Assignee: Interatom GmbH, Bergisch Gladbach, Fed. Rep. of Germany

[21] Appl. No.: 191,264

[22] Filed: May 6, 1988

[30] Foreign Application Priority Data

May 21, 1987 [DE] Fed. Rep. of Germany ..... 3717152

[51] Int. Cl.[4] ..... B22D 19/00

[52] U.S. Cl. ..... 164/98; 164/108; 164/110

[58] Field of Search ..... 164/98, 108, 110

[56] References Cited

U.S. PATENT DOCUMENTS

| | | | |
|---|---|---|---|
| 2,763,919 | 9/1956 | Kempe et al. . | |
| 3,718,172 | 2/1973 | Rice et al. | 154/98 |
| 3,919,755 | 11/1975 | Kancko et al. | 164/76.1 |
| 4,206,598 | 6/1980 | Rao et al. | 164/98 |
| 4,291,741 | 9/1981 | Willem | 164/98 |
| 4,376,374 | 3/1983 | Bothwell . | |
| 4,546,048 | 8/1985 | Guenther . | |
| 4,604,779 | 8/1986 | Narita et al. | 164/98 |
| 4,651,630 | 3/1987 | Zellinger et al. | 164/98 |

FOREIGN PATENT DOCUMENTS

| | | | |
|---|---|---|---|
| 928322 | 11/1947 | France . | |
| 34473 | 8/1984 | Japan | 164/98 |
| 21173 | 2/1985 | Japan | 164/98 |
| 1023822 | 2/1986 | Japan | 164/98 |
| 283447 | 12/1986 | Japan | 164/98 |

OTHER PUBLICATIONS

Patent Abstracts of Japan, vol. 10, No. 253 (M-512) [2309], Aug. 29, 1986; & Japan 61 79818 (Hino Motors Ltd.) Apr. 23, 1986.

Patent Abstracts of Japan, vol. 8, No. 227 (M-332) [1664], Oct. 18, 1984; & Japan 59 108848 (Nissan Jidosha K.K.), Jun. 23, 1984.

Patent Abstracts of Japan, vol. 8, No. 193 (C-241) [1630], Sep. 5, 1984; Japan 59 85866 (Mitsubishi Jukogyo K.K.), May 17, 1984.

*Primary Examiner*—Nicholas P. Godici

*Assistant Examiner*—Edward A. Brown

*Attorney, Agent, or Firm*—Herbert L. Lerner; Laurence A. Greenberg

[57] ABSTRACT

A method for producing a metallic component provided with a ceramic lining in a mold includes applying a first ceramic layer to a mold. A sliding layer is applied to the first ceramic layer. A second ceramic layer divided by joints into individual zones is applied to the sliding layer. The second ceramic layer is coated with a metal forming a finished component.

16 Claims, 1 Drawing Sheet

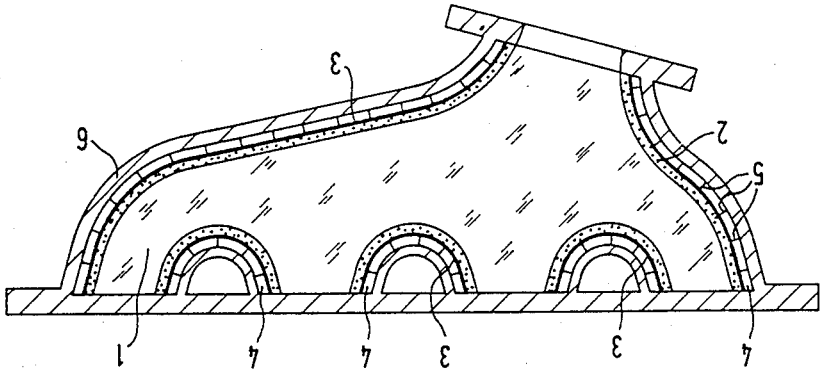
1
4
4
3
3
4
5
2
3
6

METHOD FOR PRODUCING A CERAMIC-COATED METALLIC COMPONENT

This invention relates to a method for producing a metallic component provided with a ceramic lining on a core, wherein a first ceramic layer is applied to said core.

The corporate assignee of the instant application has developed a method by which cast parts of metal material can be provided with a smooth cast-in lining, examples of which are port liners in internal combustion engines. In that method layers are applied successively by flame spraying or plasma spraying on a lost core. The composition of the layers is so varied that a gradual transition from a purely ceramic composition to a final purely metallic composition is attained. An arbitrary thick layer of metal can be cast on the purely metal composition in order to finish the component. The graduated transition from ceramic to metal provides a gradual reduction in the strains caused in the component due to the different thermal expansions of the two materials.

It is accordingly an object of the invention to provide a method for producing a ceramic-coated metallic component, which provides an alternative solution for the same technological problem dealt with by the heretofore-known methods of this general type, namely a coating disposed on hollow metallic components, preferably on the inside of such components.

With the foregoing and other objects in view there is provided, in accordance with the invention, a method for producing a metallic component provided with a ceramic lining in a mold, which comprises applying a first ceramic layer to a core, applying a sliding layer to the first ceramic layer; applying a second ceramic layer divided by joints into individual zones to the sliding layer; and coating the second ceramic layer with metal by casting metal thereunto in said mold thus forming the finished component.

The first ceramic layer substantially forms the desired thermal protection layer and the thickness and porosity thereof should be dimensioned to this end. Layers (which can be produced by various conventional methods) from 2 to 3 mm thick (optionally formed of a plurality of successively applied partial layers) appear to be suitable. The sliding layer, in turn, need only have a thickness of 0.05 to 0.1 mm and because of its ductility (which at these slight thicknesses is also present when metal is used) it provides a reduction of strains by allowing the two ceramic layers to slide over one another. A layer thickness of 0.1 to 1 mm is recommended for the second ceramic layer. Distributing the second ceramic layer over numerous segments which are separated from one another by joints or seams that are a few hundredths of a millimeter in thickness, makes it possible to reduce the strains that arise during cooling by means of a closure of the joints or seams because of its greater thermal contraction, after the layer having the metal is cast. If a new temperature increase later takes place during operation, the second ceramic layer can adapt to it due to the reopening of the joints or seams.

In accordance with another mode of the invention, there is provied a method which comprises forming the joints in the second ceramic layer with a grid disposed on the sliding layer, and forming the grid from a material that is combusted or sublimed by applying the second ceramic layer and/or by casting the second ceramic layer. This provides a method for producing the required seams in a defined size and with a defined frequency or spacing. Various plastics appear suitable for producing the grid.

In accordance with a further mode of the invention, there is provided a method which comprises producing the first ceramic layer from a material from the group consisting of aluminum titanium oxide, magnesium aluminum silicate, zirconium silicate or mullite. Like the materials proposed below for the second ceramic layer, these materials have a low modulus of elasticity, so that the transmission of vibrations to the metal parts is damped.

In accordance with an added mode of the invention, there is provided a method which comprises producing the sliding layer from a metal.

In accordance with an additional mode of the invention, there is provided a method which comprises producing the sliding layer from a material from the group consisting of titanium, a nickel-aluminum alloy, a nickel-chrome alloy, a nickel-chrome-aluminum-yttrium alloy, a nickel-cobalt-chrome-aluminum-yttrium alloy, or a cobalt-chrome-aluminum-yttrium alloy.

In accordance with yet another mode of the invention, there is provided a method which comprises forming the sliding layer from a material from the group consisting of molybdenum disulfide or boron nitride.

These are all alternative materials which are suitable for producing the sliding layer.

In accordance with yet a further mode of the invention, there is provided a method which comprises producing the second ceramic layer from a material from the group consisting of aluminum titanium oxide, zirconium oxide/magnesium oxide, zirconium oxide/yttrium oxide, zirconium silicon oxide, magnesium aluminum silicate, aluminum oxide/silicon oxide, translucent fused quartz or vitreous fused silica, mullite or spinel. These materials, which are suitable for forming the second ceramic layer, have the required resistance to alternating temperature stresses while having good mechanical properties and sufficient chemical resistance.

In accordance with yet an added mode of the invention, there is provided a method which comprises applying the first and second ceramic layers by plasma spraying or flame spraying. In accordance with yet an additional mode of the invention, there is provided a method which comprises applying the sliding layer by plasma spraying or flame spraying.

These closely related methods for producing the ceramic layers and for producing the sliding layer are particularly suitable for producing thin, uniform layers on surfaces with a complex shape. They have a certain roughness on the free surface thereof, which is useful is causing the individual layers to better mesh with one another.

The method according to the invention appears to be particularly suitable for lining the interior of hollow bodies with ceramic protective layers. Therefore, in accordance with still another mode of the invention, there is provided a method which comprises providing the core in the form of a lost core for producing a hollow component with a ceramic lining on the inner surface thereof. The use of lost cores upon which the component is assembled, is recommended for this purpose.

In accordance with a concomitant mode of the invention, there is provided a method which comprises forming the core of glass. This provides that a very smooth inner surface of the coated component is attained. This glass core may be hollow or solid. If low-melting-point metals are used, the glass can be replaced with a suitable plastic. If the glass core is solid it is liquified and drained during the metal casting step. If hollow, the thermal shock of said casting step will shatter the glass core. The particles can then be shaken out.

Other features which are considered as characteristic for the invention are set forth in the appended claims.

Although the invention is illustrated and described herein as embodied in a method for producing a ceramic-coated metallic component, it is nevertheless not intended to be limited to the details shown, since various modifications can be made therein without departing from the spirit of the invention and within the scope and range of equivalents of the claims.

The method of operation of the invention, however, together with additional objects and advantages thereof will be best understood from the following description of specific embodiments when read in connection with the accompanying drawing.

The drawing is a longitudinal-sectional view of the exhaust manifold of an internal combustion engine used as an example for explaining an embodiment of the invention.

Referrring now in detail to the single FIGURE of the drawing, in which the thicknesses of the various layers are greatly exaggerated for the sake of a graphic representation, there is seen a so-called lost core 1 of glass serving as a mold, on which a first ceramic layer 2 that is several millimeters thick has been applied by plasma or flame spraying. The core is referred to as a lost core because it is not present in the finished product. It is removable by shattering from thermal shock, or by melting and draining during the subsequent melt casting. A very thin sliding, slippery or slippage layer or film 3 of metal, boron nitride or molybdenum disulfide is applied on the first ceramic layer 2 and a second ceramic layer 4 is applied to the sliding layer 3 by the same method. The second ceramic layer 4 is divided by thin joints or seams 5 into individual zones. The joints or seams 5 represent gaps left behind from the combustion of a grid previously occupying their location. By casting of the structure thus produced with a metal 6 such as cast aluminum or cast iron, forming the actual body of the component, and by subsequent removal or destruction of the core 1, the component is produced in finished form. Glass cores (1) are destroyed by the thermal shock during the casting of the metal (6).

The foregoing is a description corresponding in substance to German Application No. P 37 17 152.6, dated May 21, 1987, the International priority of which is being claimed for the instant application, and which is hereby made part of this application. Any material discrepancies between the foregoing specification and the aforementioned corresponding German application are to be resolved in favor of the latter.

I claim:

1. A method for producing a metallic component provided with a ceramic lining which comprises the steps of:

(a) applying a first ceramic layer to a removable core;
(b) applying a sliding layer to the first ceramic layer;
(c) applying a second ceramic layer divided by joints into individual zones to the sliding layer; and
(d) melt casting around the second ceramic layer with metal to form said finished component.

2. The method according to claim 1, which comprises forming the joints in the second ceramic layer with a grid disposed on the sliding layer, and forming the grid from a material that is combusted or sublimed when applying the second ceramic layer and then metal coating the second ceramic layer by melt casting to form said finished component.

3. The method according to claim 1, which comprises forming the joints in the second ceramic layer with a grid disposed on the sliding layer, and forming the grid from a material that is combusted or sublimed by applying the second ceramic layer.

4. The method according to claim 1, which comprises forming the joints in the second ceramic layer with a grid disposed on the sliding layer, and forming the grid from a material that is combusted or sublimed by coating the second ceramic layer.

5. The method according to claim 1, which comprises producing the first ceramic layer from a material from the group consisting of aluminum titanium oxide, magnesium aluminum silicate, zirconium silicate and mullite.

6. The method according to claim 1, which comprises producing the sliding layer from a metal.

7. The method according to claim 6, which comprises producing the sliding layer from a material from the group consisting of titanium, a nickel-aluminum alloy, a nickel-chrome alloy, a nickel-chrome-aluminum-yttrium alloy, a nickel-cobalt-chrome-aluminum-yttrium alloy, and a cobalt-chrome-aluminum-yttrium alloy.

8. The method according to claim 1, which comprises forming the sliding layer from a material from the group consisting of molybdenum disulfide and boron nitride.

9. The method according to claim 1, which comprises producing the second ceramic layer from a material from the group consisting of aluminum titanium oxide, zirconium oxide/magnesium oxide, zirconium oxide/yttrium oxide, zirconium silicon oxide, magnesium aluminum silicate, aluminum oxide/silicon oxide, translucent fused quartz, mullite and spinel.

10. The method according to claim 1, which comprises applying the first and second ceramic layers by plasma spraying.

11. The method according to claim 1, which comprises applying the first and second ceramic layers by flame spraying.

12. The method according to claim 1, which comprises applying the sliding layer by plasma spraying.

13. The method according to claim 1, which comprises applying the sliding layer by flame spraying.

14. The method according to claim 1, which comprises providing the removeable core for said first ceramic layer in the form of a lost core for producing a hollow component with said ceramic linings on the inner surface thereof.

15. The method according to claim 10, which comprises forming the core of glass to provide a smooth inner surface.

16. The method according to claim 15, wherein said glass core is hollow glass and is "lost" by the thermal shock of melt casting the metal to form said finished component.

* * * * *